US007844199B2

(12) United States Patent
Suzuki et al.

(10) Patent No.: US 7,844,199 B2
(45) Date of Patent: Nov. 30, 2010

(54) IMAGE FORMING APPARATUS HAVING DETACHABLE INTERMEDIATE TRANSFER BODY

(75) Inventors: Shiroh Suzuki, Ebina (JP); Kazuyoshi Hagiwara, Ebina (JP); Masaaki Tokunaga, Ebina (JP); Yousuke Hasegawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 378 days.

(21) Appl. No.: 12/119,529

(22) Filed: May 13, 2008

(65) Prior Publication Data

US 2009/0123178 A1 May 14, 2009

(30) Foreign Application Priority Data

Nov. 14, 2007 (JP) ..... 2007-296027

(51) Int. Cl.
*G03G 15/08* (2006.01)

(52) U.S. Cl. ..... 399/121

(58) Field of Classification Search ..... 399/121, 399/302, 308, 312, 313
See application file for complete search history.

(56) References Cited

U.S. PATENT DOCUMENTS

| | | | | |
|---|---|---|---|---|
| 6,463,236 | B2 * | 10/2002 | Morikami et al. | 399/121 |
| 7,257,351 | B2 * | 8/2007 | Tachiki et al. | 399/121 |
| 7,444,100 | B2 * | 10/2008 | Sato | 399/110 |
| 7,526,227 | B2 * | 4/2009 | Sato et al. | 399/110 |
| 2006/0104664 | A1 | 5/2006 | Nakahata | |
| 2008/0044201 | A1 | 2/2008 | Nakahata | |
| 2009/0123196 | A1 * | 5/2009 | Nakao et al. | 399/301 |

FOREIGN PATENT DOCUMENTS

| | | | |
|---|---|---|---|
| CN | 1776545 | A | 5/2006 |
| JP | 10-26922 | A | 1/1998 |
| JP | 2000-275987 | A | 10/2000 |
| JP | 2001-013800 | A | 1/2001 |
| JP | 2002-304104 | A | 10/2002 |
| JP | 2004-5381 | A | 1/2004 |

(Continued)

OTHER PUBLICATIONS

Notification of the First Office Action dated May 20, 2010, issued in counterpart Chinese Application No. 200810126613.4.

(Continued)

*Primary Examiner*—Robert Beatty
(74) *Attorney, Agent, or Firm*—Sughrue Mion, PLLC

(57) ABSTRACT

An image forming apparatus includes: an apparatus body including: an image forming unit that forms toner images having the colors being different from each other; a intermediate transfer body that has a belt-shape, and that is arranged in an upper portion of the image forming unit being inclined with respect to the horizontal direction, the toner images being transferred onto the intermediate transfer body; an intermediate transfer body unit that detachably holds the intermediate transfer body with respect to the apparatus body; and a guide rail member that detachably guides the intermediate transfer body unit in a direction of one side of the apparatus body, and that is set so that the direction, in which the intermediate transfer body unit is guided, is changed in the middle of guiding.

8 Claims, 14 Drawing Sheets

FOREIGN PATENT DOCUMENTS

| | | | | |
|---|---|---|---|---|
| JP | 2004-138945 | A | | 5/2004 |
| JP | 2004-325476 | A | | 11/2004 |
| JP | 3783908 | B2 | | 3/2006 |
| JP | 2006-163192 | A | | 6/2006 |
| JP | 2006171534 | A | * | 6/2006 |
| JP | 2006259044 | A | * | 9/2006 |

OTHER PUBLICATIONS

Japanese Office Communication Dated Nov. 10, 2009 with English Translation thereof.

* cited by examiner

IMAGE FORMING APPARATUS HAVING DETACHABLE INTERMEDIATE TRANSFER BODY

CROSS-REFERENCE TO RELATED APPLICATIONS

This application is based on and claims priority under 35 U.S.C. 119 from Japanese Patent Application No. 2007-296027 filed Nov. 14, 2007.

BACKGROUND

Technical Field

The present invention relates to an image forming apparatus.

Conventionally, this type image forming apparatus is composed as follows. Toner images of four colors, which are formed by four image forming units of yellow (Y), magenta (M), cyan (C) and black (K), are multiply transferred onto an intermediate transfer belt arranged in upper portions of these four image forming units. Then the toner images multiply transferred onto the intermediate transfer belt are secondarily transferred onto a recording medium all at once and then fixed. In this way, a full color image is formed. In this image forming apparatus, a cleaning device for cleaning a surface of the intermediate transfer belt, on which the transfer step has already been finished, is provided on one side end portion in the circumferential direction of the intermediate transfer belt.

In this connection, the image forming apparatus composed as described above includes an intermediate transfer belt unit for pivotally holding the intermediate transfer belt. The intermediate transfer belt unit can be freely attached to and detached from the image forming apparatus body so that the maintenance work can be executed. The image forming apparatus body also includes a cleaning device for cleaning the intermediate transfer belt. This cleaning device can be also freely attached to and detached from the image forming apparatus body.

In this case, the above image forming apparatus is composed so that the intermediate transfer belt unit can be attached to and detached from the apparatus body together with the cleaning device in a direction of one side of the apparatus body. Alternatively, the above image forming apparatus is composed so that the intermediate transfer belt unit can be attached to and detached from the front face of the apparatus body together with the cleaning device.

In this connection, in the above image forming apparatus, in order to reduce a size of the apparatus, it is possible to consider that the intermediate transfer belt is arranged in the apparatus body being inclined with respect to the apparatus body. It is also possible to consider that a width of the intermediate transfer belt concerned is decreased.

However, in the case of the related art described above, the following technical problems are encountered. In the case where the image forming apparatus is composed so that the intermediate transfer belt, which is arranged being inclined with respect to the apparatus body, can be freely attached to and detached from the apparatus body in a direction of one side of the apparatus body, when the intermediate transfer belt is attached to and detached from the apparatus body, the intermediate transfer belt unit, which is arranged being inclined with respect to the apparatus body, interferes with a sheet supplying mechanism arranged on one side of the apparatus body or interferes with an electric power circuit arranged on the other side of the apparatus body. Therefore, when the intermediate transfer belt unit is attached to and detached from the apparatus body, the sheet supplying mechanism and the electric power circuit must be once removed from the apparatus body. Accordingly, the maintenance work becomes very complicated.

In the case of the related art described above, another technical problem will be encountered which will be described as follows. In the case where the intermediate transfer belt unit, which is arranged being inclined with respect to the image forming apparatus body, is detachably attached onto the front side of the image forming apparatus body, it becomes necessary to widely open the front face of the image forming apparatus body so that the intermediate transfer belt unit concerned can be freely attached to and detached from the image forming apparatus body. Accordingly, it becomes difficult to ensure the rigidity of the frame of the apparatus body.

SUMMARY

According to an aspect of the present invention, an image forming apparatus includes: an apparatus body including: an image forming unit that forms toner images having the colors being different from each other; a intermediate transfer body that has a belt-shape, and that is arranged in an upper portion of the image forming unit being inclined with respect to the horizontal direction, the toner images being transferred onto the intermediate transfer body; an intermediate transfer body unit that detachably holds the intermediate transfer body with respect to the apparatus body; and a guide rail member that detachably guides the intermediate transfer body unit in a direction of one side of the apparatus body, and that is set so that the direction, in which the intermediate transfer body unit is guided, is changed in the middle of guiding.

BRIEF DESCRIPTION OF THE DRAWINGS

Exemplary embodiment of the present invention will be described in detail based on the following figures, wherein.

DETAILED DESCRIPTION

Figure 1:
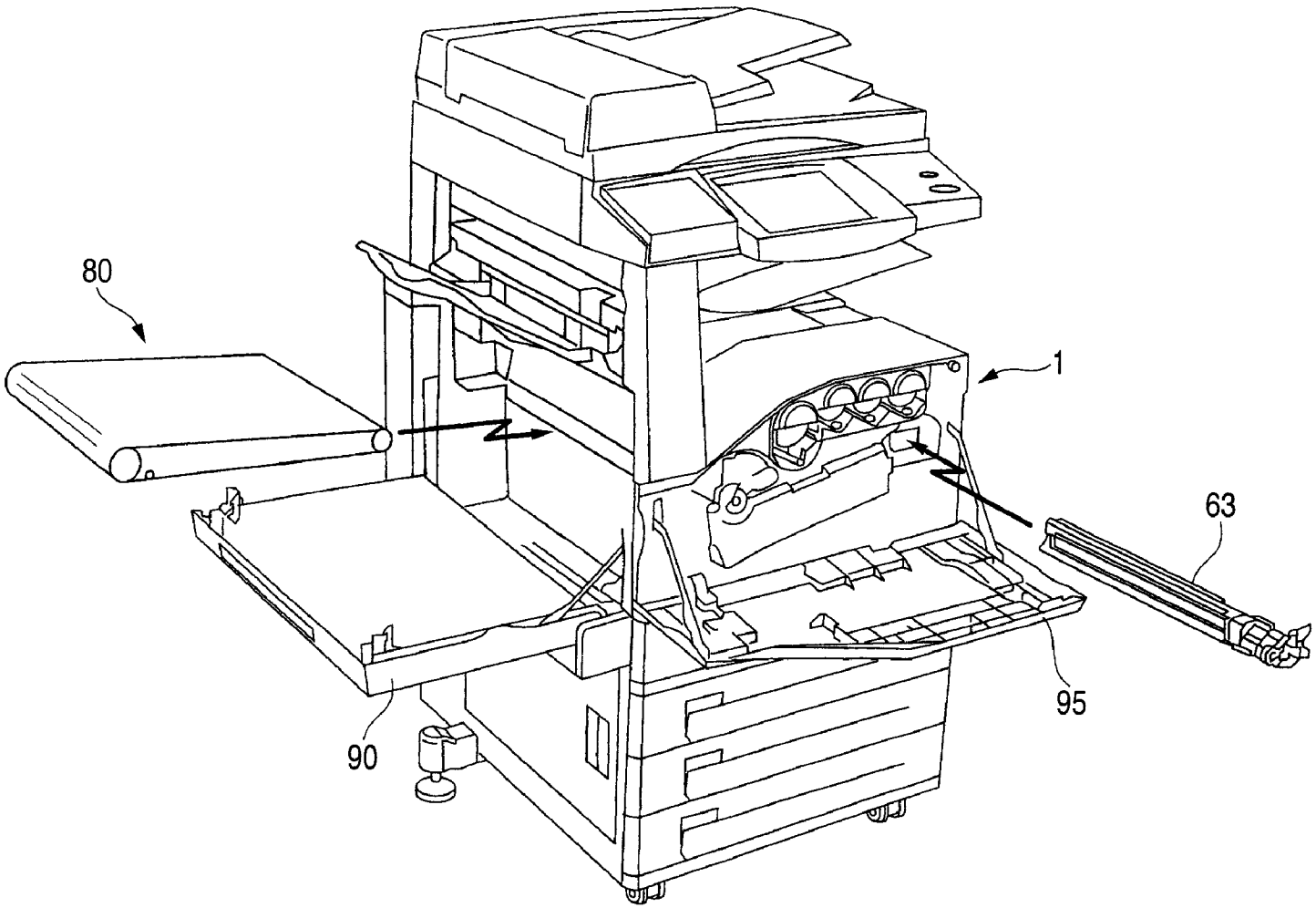
FIG. 1 is a perspective view showing appearance of a tandem type full color multi function machine that is an image forming apparatus of Embodiment 1 of the present invention.

Referring to the drawings, an embodiment of the present invention will be explained below.

Embodiment 1

Figure 2:
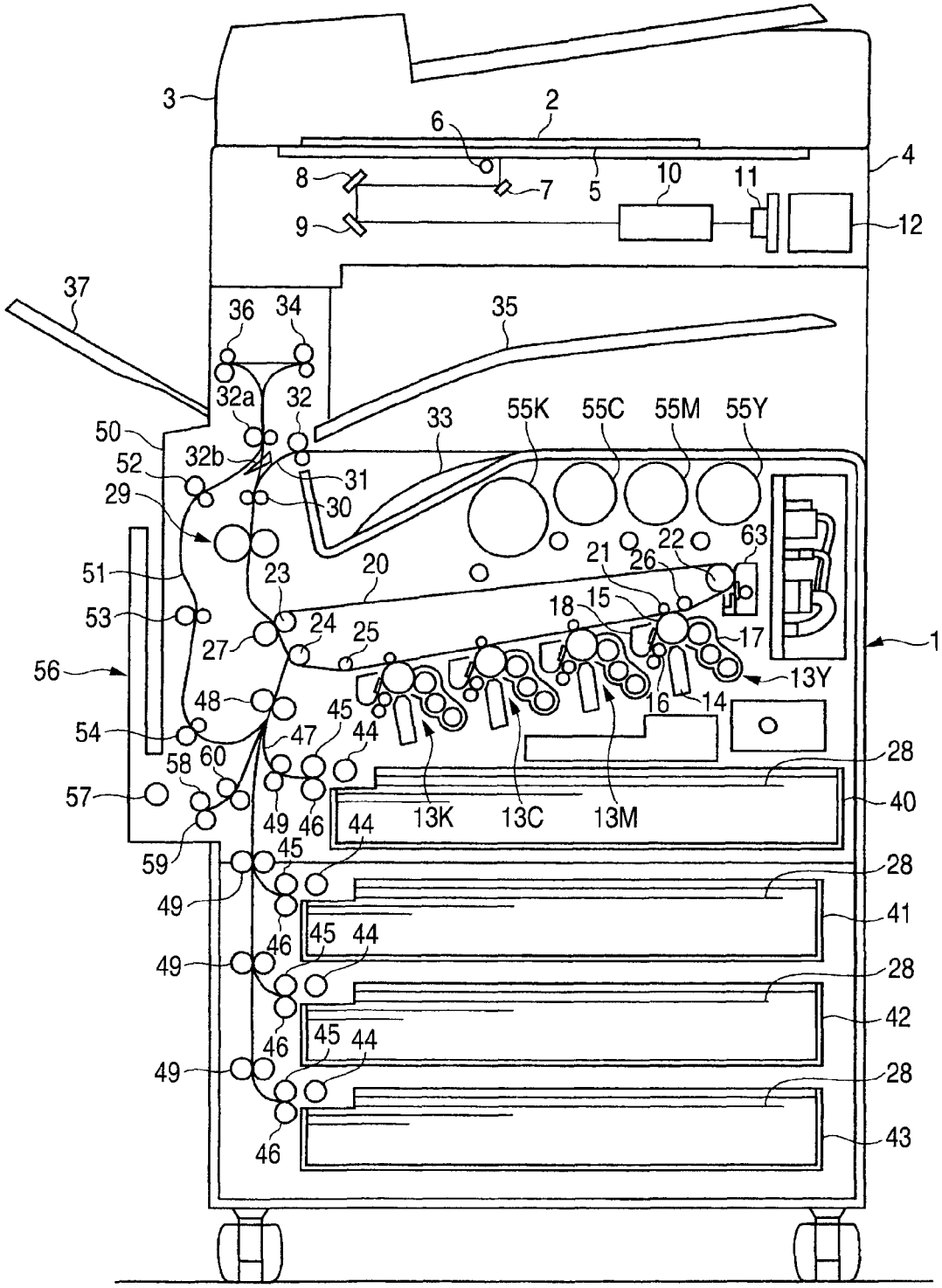
FIG. 2 is an overall arrangement view showing a tandem type full color multi function machine that is an image forming apparatus of Embodiment 1 of the present invention.

FIG. 2 is a view showing a tandem type digital color multi function machine which is an image forming apparatus of Embodiment 1 of the present invention. This tandem type digital color multi function machine has an image reading device. However, of course, the tandem type digital color multi function machine may be applied to a printer having no image reading device.

In FIG. 2, reference numeral 1 is a main body of the tandem type digital color multi function machine. An automatic document conveying device 3 for automatically conveying documents 2 one by one and a document reading machine 4 for reading an image on the document 2 conveyed by the automatic document conveying device 3 are arranged in an upper portion of this multi function machine body 1. This document reading device 4 illuminates the document 2, which is placed on the platen glass 5, by the light source 6. Therefore, an reflected optical image of the document 2 is exposed and scanned on the image reading element 11 having CCD through the reduced optical system including the full-rate mirror 7, the half-rate mirrors 8, 9 and the condensing lens 10. In this way, the reflected optical image of the document 2 can be read out by the image reading element 11 at a predetermined dot density, for example, 16 dot/mm.

The reflected optical image of the document 2, which has been read out by the above document reading device 4, is sent to the image processing device 12 as document reflectance data of three colors of red (R), green (G) and blue (B) (8 bit data). This image processing device 12 conducts image processing such as a shading correction, positional shift correction, lightness/color space conversion, gamma correction, frame erasing and color/movement editing on the reflectance data of the document 2. The image processing device 12 is composed so that it can conduct image processing on image data sent from a personal computer not shown.

Image data, which has been subjected to image processing by the image processing device 12 as described above, is converted into gradation data of four colors of yellow (Y), magenta (M), cyan (C) and black (K) by the same image processing device 12 (8 bit data). As described later, the image data is sent to the image exposing devices 14 of the image forming units 13Y, 13M, 13C, 13K of yellow (Y), magenta (M), cyan (C) and black (K). In these image exposing devices 14, according to gradation data of document 2 of a predetermined color, image exposure is executed by light emergent from LED light emitting element array.

In this connection, this embodiment includes: a plurality of image forming units for forming toner images of different colors; and a belt-shaped intermediate transfer body, which is arranged being inclined with respect to the horizontal direction in an upper portion of the plurality of image forming units, onto which toner images formed by the plurality of image forming units are transferred.

As shown in FIG. 2, the above tandem type digital color multi function machine body 1 includes four image forming units 13Y, 13M, 13C, 13K of yellow (Y), magenta (M), cyan (C) and black (K) which are arranged in such a manner that the image forming units are inclined by a predetermined angle with respect to the horizontal direction so that the image forming unit 13Y of the first color of yellow (Y) can be arranged at a high position and the image forming unit 13K of the last color of black (K) can be arranged at a low position, wherein these image forming units are arranged at predetermined intervals in parallel with each other.

When the four image forming units 13Y, 13M, 13C, 13K of yellow (Y), magenta (M), cyan (C) and black (K) are arranged being inclined by a predetermined angle, it is possible to shorten a distance in the width direction as compared with a case in which the four image forming units 13Y, 13M, 13C, 13K are arranged in the horizontal direction. Accordingly, a distance in the width direction can be shortened and the apparatus body 1 can be downsized in the width direction.

Figure 3:
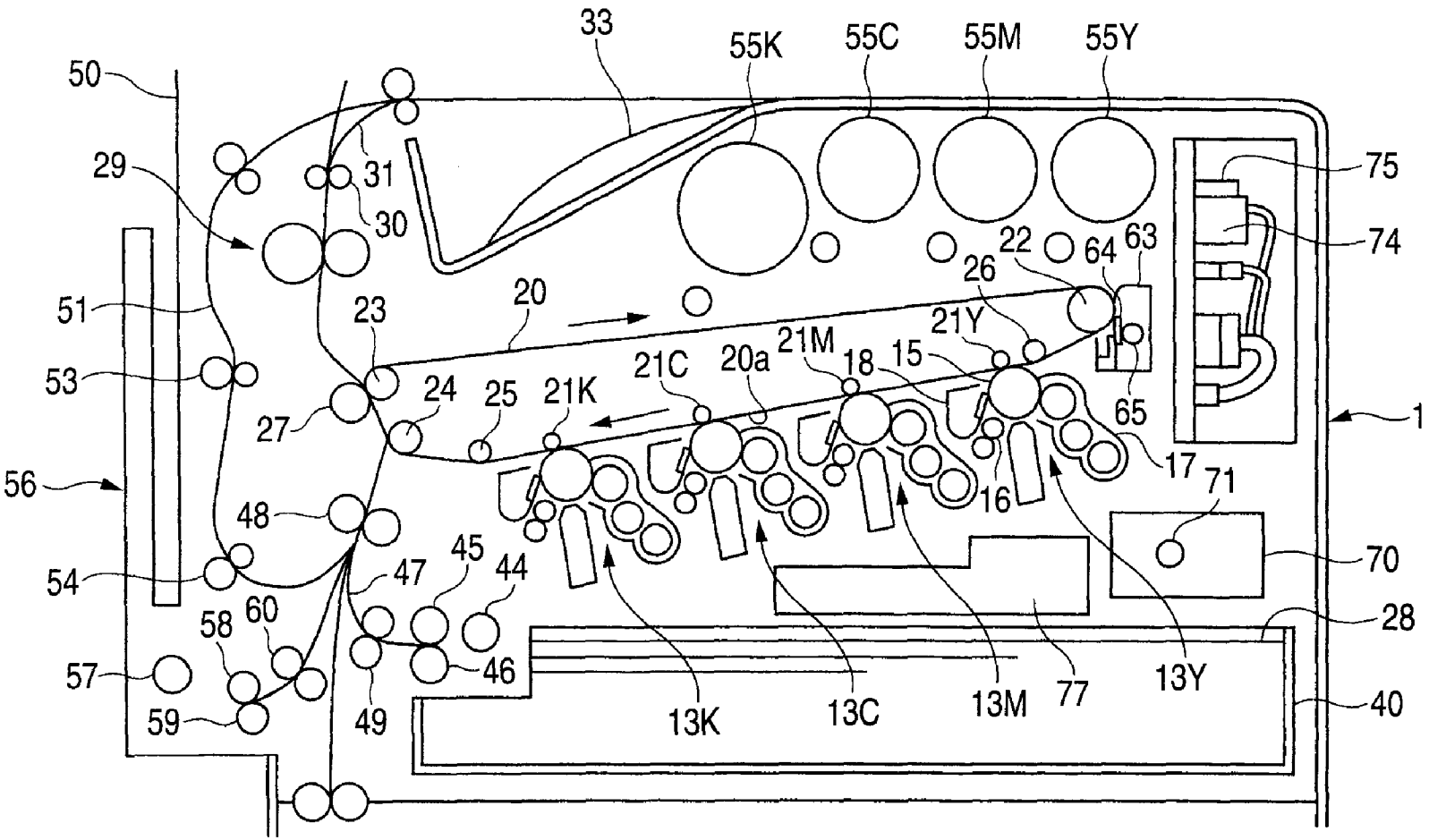
FIG. 3 is an arrangement view showing an image forming unit of a tandem type full color multi function machine that is an image forming apparatus of Embodiment 1 of the present invention.

These four image forming units 13Y, 13M, 13C, 13K are basically composed in the same manner. As shown in FIGS. 2 and 3, each image forming unit includes: a photoreceptor drum 15 which is an image carrying body rotated by a drive means not shown at a predetermined rotary speed; a charging roller 16 for uniformly charging a surface of the photoreceptor drum 15 so as to primarily charge the photoreceptor drum 15; an image exposing device 14 composed of LED print head for forming an electrostatic latent image on the surface of the photoreceptor drum 15 by exposing an image corresponding to a predetermined color; a developing device 17 for developing the electrostatic latent image formed in the photoreceptor drum 15 by toner of a predetermined color; and a cleaning device 18 for cleaning a surface of the photoreceptor drum 15.

The photoreceptor drum 15 is a drum, the diameter of which is 30 mm, which is made of an organic photoreceptor having an over-coating layer on the surface. This photoreceptor drum 15 is rotated by a drive motor not shown at a predetermined rotary speed.

For example, the charging roller 16 is a roller-shaped charger, the surface of the core metal of which is covered with a conductive layer made of synthetic resin or rubber so that the electric resistance can be adjusted. The core metal of this charging roller 16 is impressed with a predetermined charging bias. On a surface of this charging roller 16, the cleaning roller 16*a* for removing foreign objects such as toner, which have been attached onto the surface of the charging roller 16, is arranged being contacted with the surface of this charging roller 16.

As shown in FIG. 2, the image exposing devices 14 are respectively arranged in four image forming units 13Y, 13M, 13C, 13K. Each image exposing device 14 includes: an LED light emitting element array in which LED light emitting elements are linearly arranged at predetermined intervals (for example, 600 dpi); and a Celfox lens (brand name) for forming a spot-shaped image out of light that is emergent from each LED light emitting element of the LED light emitting array concerned. As shown in FIG. 2, the above image forming device 14 is composed so that it can form an image on the photoreceptor drum 15 when scanning is made from downward.

In the image processing device 12 described above, image data of each color is outputted in order to the image exposing device 14Y, 14M, 14C, 14K individually provided in the image forming unit 13Y, 13M, 13C, 13K of each color of yellow (Y), magenta (M), cyan (C) and black (K). A light beam from each image exposing device 14Y, 14M, 14C, 14K in accordance with image data is subjected to scanning exposure onto a surface of the corresponding photoreceptor drum 15, so that an electrostatic latent image can be formed. Electrostatic latent images formed on the photoreceptor drums 15 are respectively developed by the developing devices 17Y, 17M, 17C, 17K so that toner images of yellow (Y), magenta (M), cyan (C) and black (K) can be formed.

The toner images of yellow (Y), magenta (M), cyan (C) and black (K), which have been formed in order on the photoreceptor drums 15 of the image forming units 13Y, 13M, 13C, 13K, are multiply transferred onto the intermediate transfer belt 20, which is a belt-shaped intermediate transfer body obliquely arranged in upper portions of the image forming units 13Y, 13M, 13C, 13K, by the primary transfer rollers 21.

This intermediate transfer belt 20 is a belt-shaped member provided between a plurality of rollers. The intermediate transfer belt 20 is arranged being inclined with respect to the horizontal direction so that a lower side running region of the belt-shaped member concerned can be lowered on the downstream side in the running direction and an upstream side running region of the belt-shaped member can be raised.

As shown in FIG. 3, the above intermediate transfer belt 20 is provided being wound round the drive roller 22, the backup roller 23, the tension roller 24, the first idle roller 25 and the second idle roller 26 being given a predetermined tension. This intermediate transfer belt 20 is driven and circulated in the arrowed direction at a predetermined speed by the drive roller 22 that is driven and rotated by an exclusively used drive motor to be rotated at a constant speed. For example, the above intermediate transfer belt 20 is composed in such a manner that a flexible film made of synthetic resin such as PET is formed into a belt-shape. Both end portions of this belt-shaped synthetic resin film are connected to each other by means of welding. In this way, an endless belt is formed so that it can be used for the intermediate transfer belt 20. The above intermediate transfer belt 20 is arranged so that its lower running region can be contacted with the photoreceptor drums 15Y, 15M, 15C, 15K of the image forming units 13Y, 13M, 13C, 13K.

Figure 4:
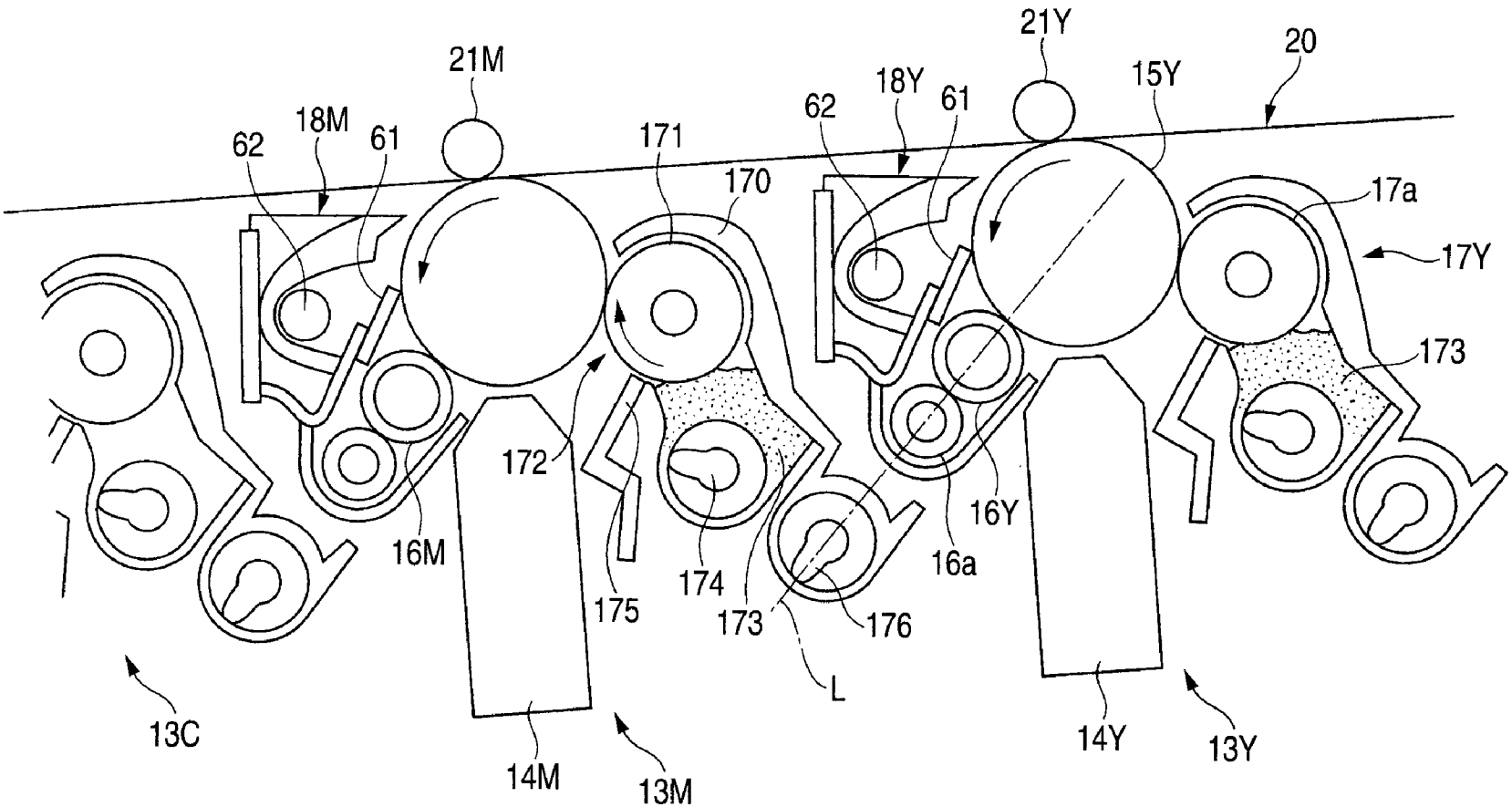
FIG. 4 is an enlarged arrangement view showing an image forming unit of a tandem type full color multi function machine that is an image forming apparatus of Embodiment 1 of the present invention.
Figure 5:
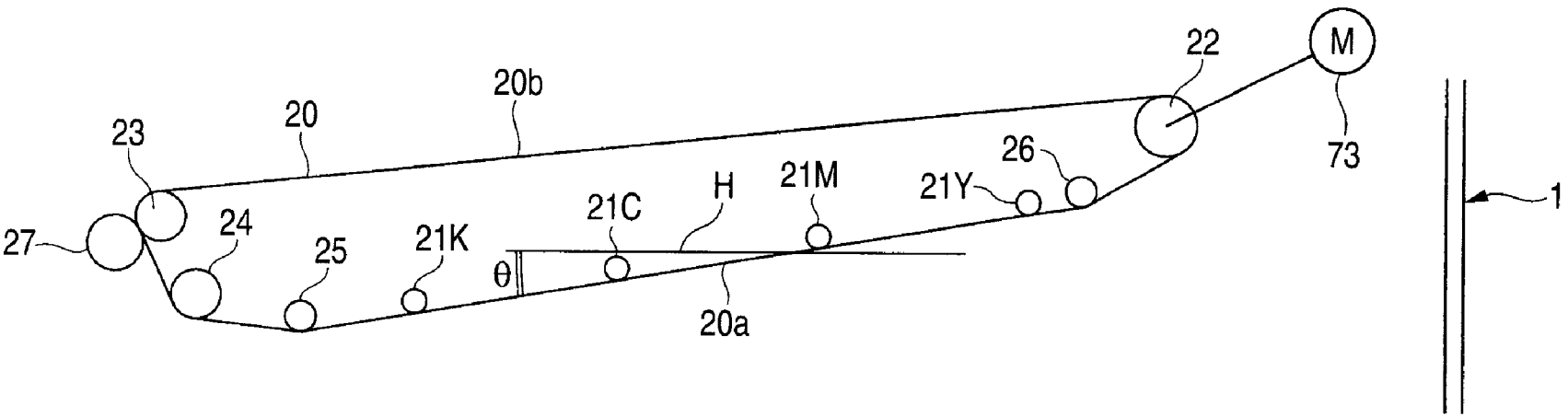
FIG. 5 is an arrangement view showing a state in which an intermediate transfer belt is provided being stretched.

As shown in FIGS. 4 and 5, the secondary transfer roller 27 is arranged which is serving as a secondary transfer means for secondarily transferring a toner image, which is primarily transferred onto the intermediate transfer belt 20, onto a recording medium, is arranged at the lower side end of the intermediate transfer belt arranged being inclined with respect to the horizontal direction H by an angle . in such a manner that the secondary transfer roller 27 comes into contact with a surface of the intermediate transfer belt 20 which is stretched by the backup roller 23.

Toner images of yellow (Y), magenta (M), cyan (C) and black (K), which have been multiply transferred onto the above intermediate transfer belt 20, are secondarily transferred onto the recording sheet of paper 28, which is a recording medium, by the secondary transfer roller 27, which comes into pressure contact with the backup roller 23, being given a pressing force and an electrostatic force. The recording sheet of paper 28, onto which the toner images of the colors have been transferred, is conveyed to the fixing device 29 arranged in an upper position. The secondary transfer roller 27 comes into pressure contact with the side of the backup roller 23. Therefore, the toner image of each color is secondarily transferred onto the recording sheet of paper 28 that is conveyed upward from a lower position in the perpendicular direction. The recording sheet of paper 28, onto which the toner image of each color has been transferred, is subjected to the fixing processing by the fixing device 29 with heat and pressure. After that, the recording sheet of paper 28 is discharged by the first discharging roller 32 through the delivery roller 30 of the fixing device 29 and through the sheet discharging passage 31 onto the first discharging tray 33 provided in an upper portion of the apparatus body 1. Alternatively, the recording sheet of paper 28 is discharged by the second discharging roller 34 onto the second discharging tray 35 provided in an upper portion of the apparatus body 1. Alternatively, the recording sheet of paper 28 is discharged by the third discharging roller 36 onto the third face-up tray 37 provided on the side of the apparatus body 1.

As shown in FIG. 2, the recording sheet of paper 28 of a predetermined size is once conveyed from the sheet supply tray 40, which is a recording medium accommodating container, or from one of the sheet supply trays 41 to 43, which are arranged in a lower portion of the compound apparatus body 1, to the resist roller 48 through the conveyance roller 49 and the sheet conveyance passage 47 by the sheet supply roller 44 and a pair of rollers 45, 46 for separating and conveying the sheet of paper. The recording sheet of paper 28 supplied from one of the above sheet supply trays 40 to 43 is sent to a secondary transfer position of the intermediate transfer belt 20 by the resist roller 48 which is rotated at a predetermined timing.

In the case where both sides of a recording sheet of paper are subjected to full color copying in the digital color printer and the copying apparatus, the recording sheet of paper 28, on one side of which an image has already been fixed, is not discharged by the second discharging roller 34 onto the second discharging tray 35 but the conveyance direction is changed over by the changeover gate 32*b* while a trailing end of the recording sheet of paper 28 is being held by the inversion roller 32 (*a*) and the recording sheet of paper is conveyed to the conveyance unit 50 for both sides. In this conveyance unit 50 for both sides, under the condition that the surface side and the reverse side of the recording sheet of paper 28 are inverted, the recording sheet of paper 28 is conveyed to the resist roller 48 again by the pair of conveyance rollers 52 to 54 provided along the conveyance passage 51. This time, an image is transferred and fixed onto the reverse side and then the recording sheet of paper 28 is discharged onto one of the first discharging tray 33 to the third discharging tray 37.

In FIG. 2, reference marks 55Y, 55M, 55C and 55K are toner cartridges for supplying toner of each color to the developing devices 17 of the respective colors of yellow (Y), magenta (M), cyan (C), black (K). The toner cartridge for accommodating toner of black (K) is larger than the toner cartridges of other colors because the toner cartridge for accommodating toner of black (K) is frequently used.

In FIG. 2, reference numeral 56 is a hand feeding tray. A recording sheet of paper 28, the material and the size of which are predetermined, is conveyed from the hand feeding tray 56 to the resist roller 48 by the sheet supplying roller 57 and the pair of rollers 58, 59 for sheet separation and conveyance through the conveyance roller 60.

FIG. 3 is a view showing each image forming unit of the digital color printer and the copying apparatus.

As shown in FIG. 3, the image forming units 13Y, 13M, 13C, 13K of yellow, magenta, cyan and black are composed in the same manner. As described before, in these four image forming units 13Y, 13M, 13C, 13K, toner images of yellow, magenta, cyan and black are formed in order at a predetermined timing. Each image forming unit 13Y, 13M, 13C, 13K includes a photoreceptor drum 15 as described before. A surface of the photoreceptor drum 15 is uniformly charged by the charging roller 16 for primarily charging. After that, the surface of the photoreceptor drum 15 is exposed and scanned by a light beam from the image forming exposure device 14 in accordance with image data, so that an electrostatic latent image corresponding to each other can be formed. The flux of light to conduct scanning on the photoreceptor drum 15 is emergent by a predetermined angle from a portion on the right side obliquely downward with respect to a position right below the photoreceptor drum 15. An electrostatic latent image formed on the photoreceptor drum 15 is developed by the developing roller 17*a* of the developing device 17 of each image forming unit 13Y, 13M, 13C, 13K with toner of yellow, magenta, cyan and black. Therefore, the electrostatic latent image formed on the photoreceptor drum 15 is developed into a visible tone image of each color. The thus developed visible tone images of four colors are multiply transferred onto the intermediate transfer belt 20 in order by the electrical charging made by the primary transfer roller 21.

Each developing device 17Y, 17M, 17C, 17K is of the two component type developing system in which two component developer containing toner and carrier is used. On a surface of the developing roller 17*a*, a magnetic brush of the two component developer containing toner and carrier is formed so that an electrostatic latent image formed on the surface of the photoreceptor drum 15Y, 15M, 15C, 15K can be developed.

After the completion of the toner image transferring step, residual toner and paper powder are removed from the surface of the photoreceptor drum 15 by the cleaning device 18 so as to prepare for the next image forming step. The cleaning device 18 includes a cleaning blade 61. Waste toner and paper powder can be removed from the surface of the photoreceptor drum 15 by the cleaning blade 61. Waste toner and others removed by the cleaning blade 61 are conveyed to the front side of the copying machine body 1 at a predetermined timing by the auger 62 used for conveyance provided in the cleaning device 18. These waste toner and others are conveyed to the waster toner recovery container described later through a pipe for conveyance not shown in the drawing.

As shown in FIG. 2, from the surface of the intermediate transfer belt 20 after the completion of the toner image transfer step, residual toner and paper powder are removed by the cleaning device 63 after the completion of the secondary transfer so as to prepare for the next image forming process. As shown in FIG. 3, the above cleaning device 63 includes a cleaning blade 64. Residual toner and paper powder are removed from the surface of the intermediate transfer belt 20 by this cleaning blade 64. Waste toner and others removed by the cleaning blade 64 are conveyed to the front side of the copying machine body 1 at a predetermined timing by the auger 65 used for conveyance provided in the cleaning device 63. These waste toner and others are conveyed to a waste toner recovery container described later through a pipe for conveyance not shown in the drawing.

In this connection, the present embodiment includes: an intermediate transfer body unit for detachably holding the belt-shaped intermediate transfer body with respect to the image forming apparatus body; and a guide rail member for detachably guiding the intermediate transfer body unit in a direction of one side of the image forming apparatus body, wherein the guide rail member is set so that the direction, in which the intermediate transfer body unit is guided, can be changed in the middle of guiding.

That is, in the present embodiment, as shown in FIG. 3, the intermediate transfer belt 20 composes the intermediate transfer body unit 80 together with the drive roller 22 for stretching the intermediate transfer belt 20, the backup roller 23, the tension roller 24, the first idle roller 25 and the second idle roller 26. The intermediate transfer body unit 80 can be detachably attached to one side (the left side of the multi function machine body 1 in the example shown in the drawing) of the multi function machine body 1.

Figure 6A:
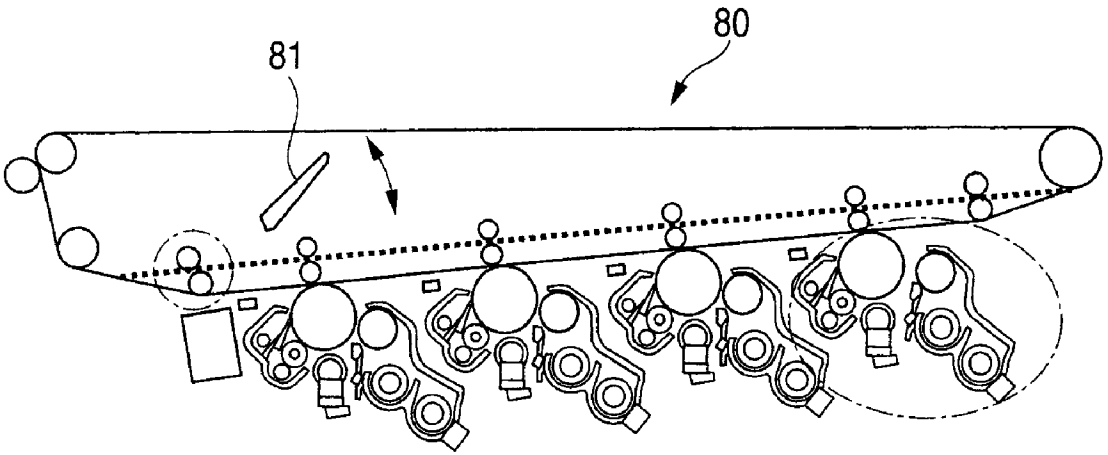
FIGS. 6A and 6B are arrangement views showing a mechanism for retracting an intermediate transfer belt.
Figure 6B:
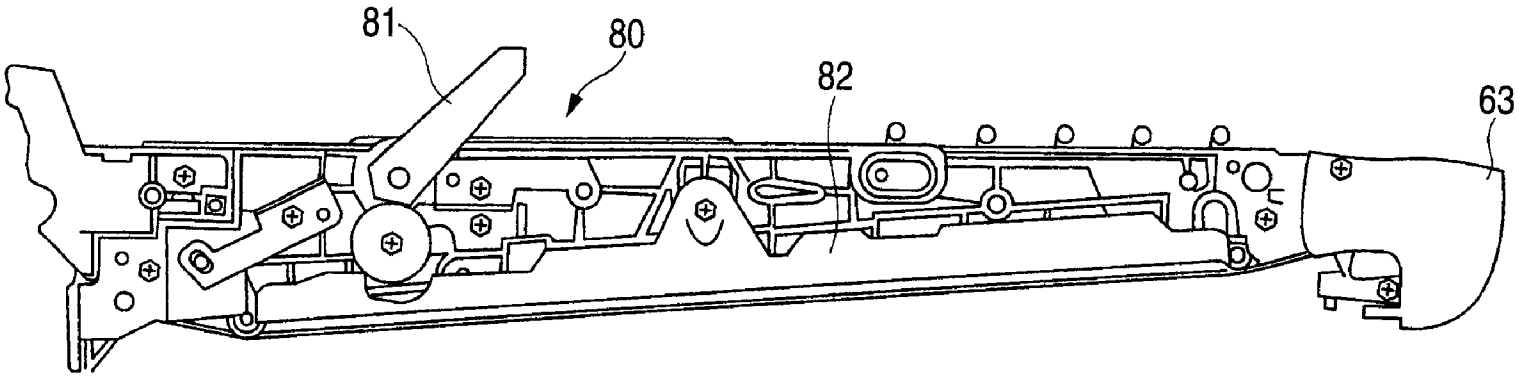

As shown in FIGS. 6A and 6B, the above intermediate transfer body unit 80 is composed as follows. When the retracting handle 81 provided in the intermediate transfer body unit 80 is operated and rotated, the first idle roller 25, the second idle roller 26 and the primary transfer rollers 21Y, 21M, 21C, 21K are retracted. Then the intermediate transfer belt 20 can be separated from the photoreceptor drums 15 of the image forming units 13Y, 13M, 13C, 13K.

Explanations are further made as follows. As shown in FIG. 6B, the retractor handle 81 is pivotally attached to the intermediate transfer body unit 80. The retractor handle 81 is connected to the holding frame 82 to which the first idle roller 25, the second idle roller 26 and the primary transfer rollers 21Y, 21M, 21C, 21K are pivotally attached through a link mechanism not shown. When the retractor handle 81 is operated being rotated, the holding frame 82 is moved in a direction perpendicular to the running direction of the intermediate transfer belt 20. Therefore, it becomes possible to separate the intermediate transfer belt 20 from the photoreceptor drums 15 of the image forming units 13Y, 13M, 13C, 13K.

Figure 9:
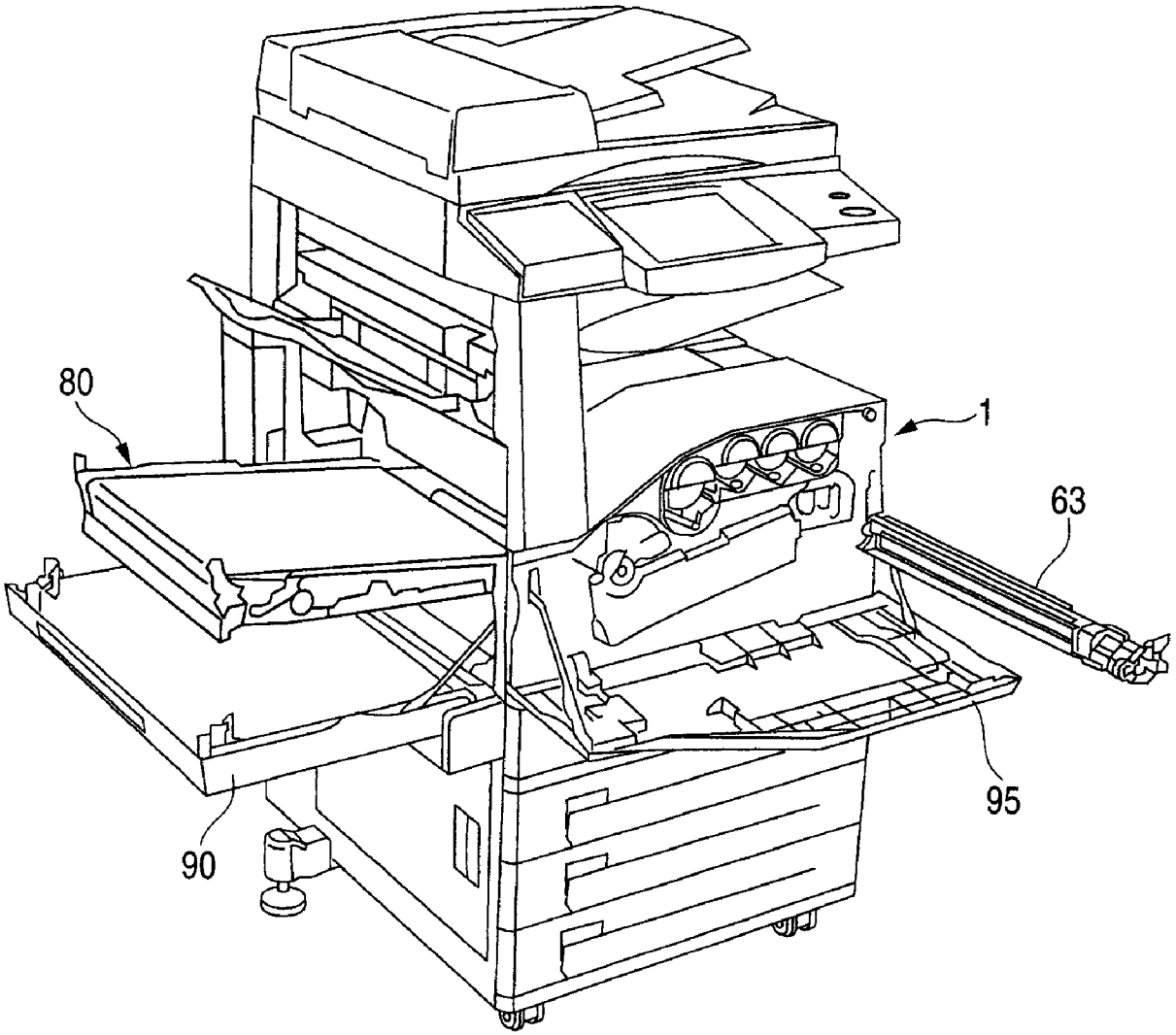
FIG. 9 is a perspective view showing appearance of a tandem type full color multi function machine that is an image forming apparatus of Embodiment 1 of the present invention.
Figure 10A:
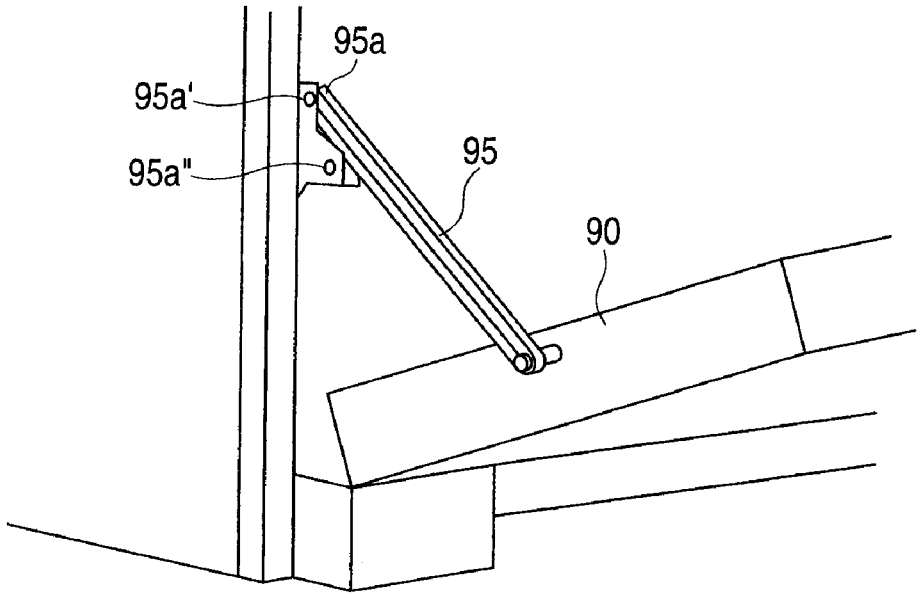
FIGS. 10A and 10B are arrangement views showing an opening and closing state of a side cover.
Figure 10B:
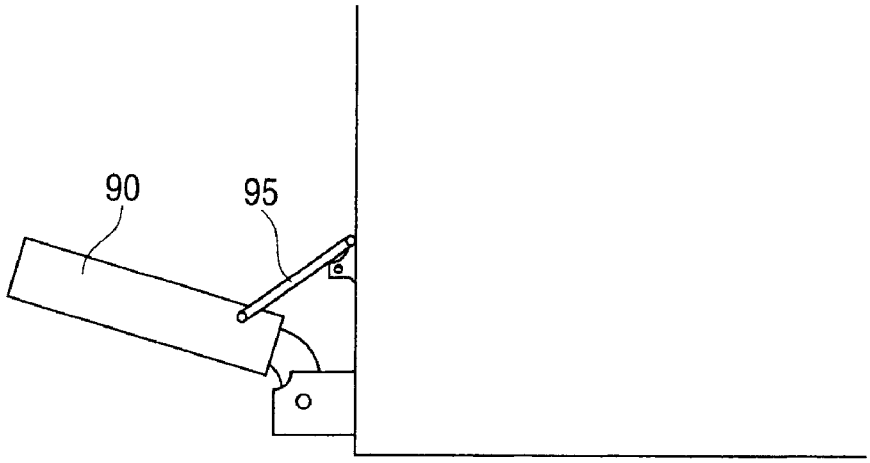

In this case, in a state in which the front cover 95 is opened as shown in FIG. 9, the retracting handle 81 penetrates the front face frame 96 and the front face guide rail not shown and connected to the intermediate transfer body unit 80. Therefore, unless the intermediate transfer belt 20 is separated from the photoreceptor drums 15 of the image forming units 13Y, 13M, 13C, 13K, the retracting handle 81 can not be detached from the intermediate transfer body unit 80, that is, a stopper mechanism is composed in this structure.

Figure 7:
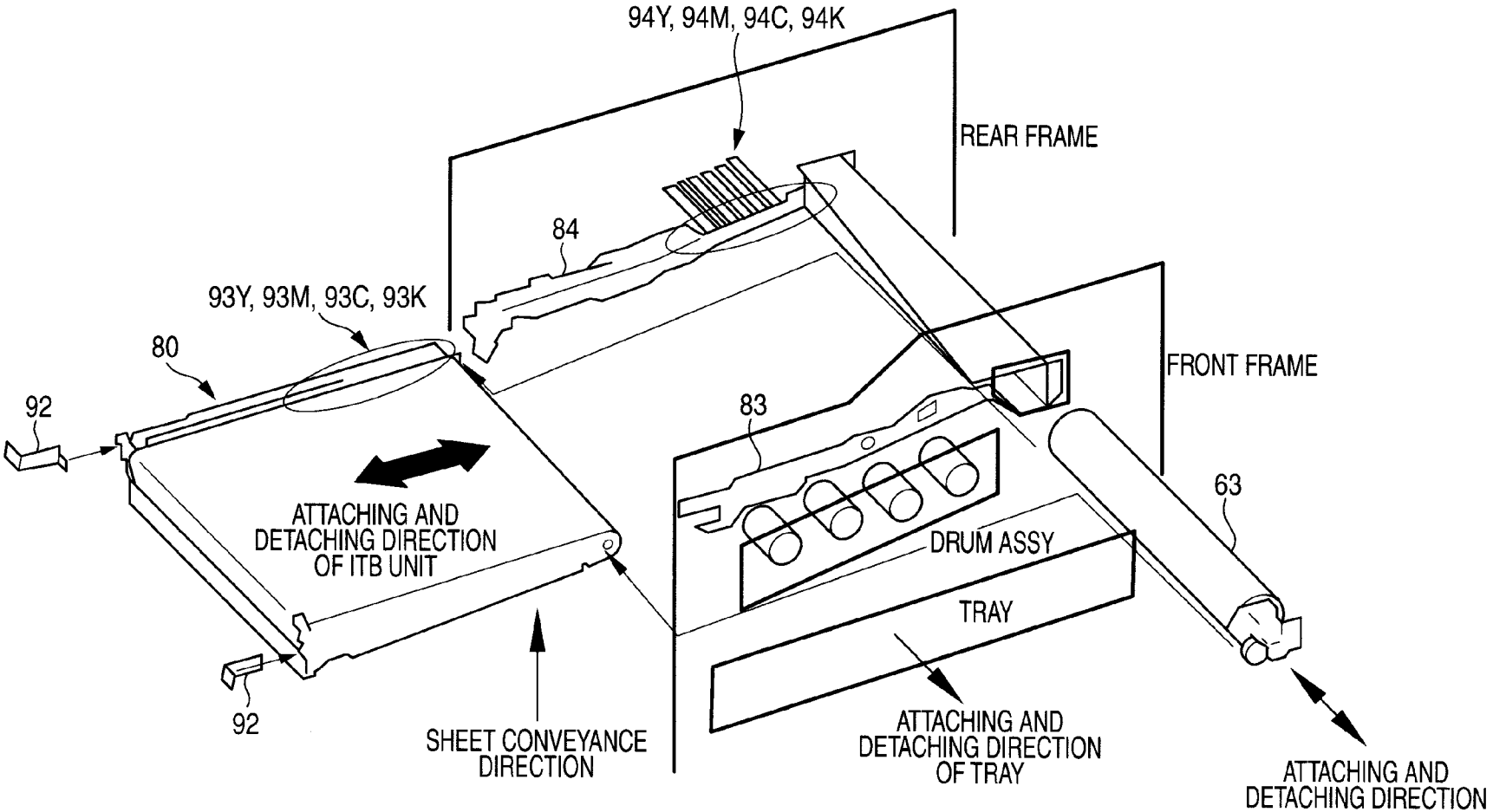
FIG. 7 is a perspective arrangement view showing an attaching and detaching mechanism of an intermediate transfer body unit.

As shown in FIG. 7, in the digital color multi function machine body 1, the guide rail members 83, 84 are attached which are members for detachably guiding the intermediate transfer body unit 80 in the direction of one side of the apparatus body 1 so that a direction of guiding the intermediate transfer unit 80 concerned can be changed in the middle. The guide rail members 83, 84 are respectively provided on the front side and the rear side of the multi function machine body 1.

Figure 8:
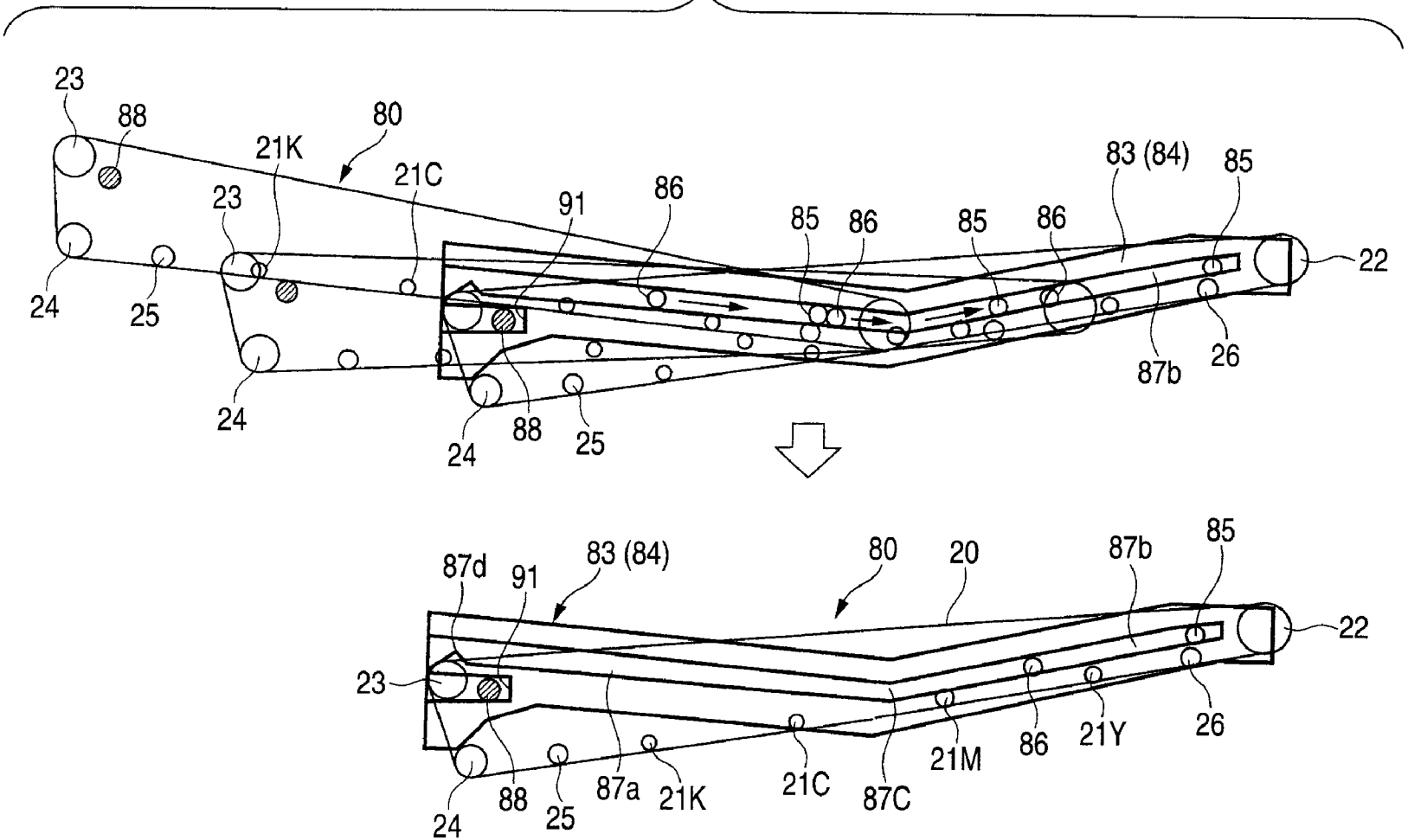
FIG. 8 is a side arrangement view showing an attaching and detaching mechanism of an intermediate transfer body unit.

As shown in FIG. 8, the guide rail members 83, 84 include a guide groove 87 for guiding the intermediate transfer unit 80 when two guide pins 85, 86 provided in the intermediate transfer unit 80 are engaged with the guide groove 87. The guide groove 87 for guiding the guide rail members 83, 84 includes: a first portion 87*a* directed in a direction in which the intermediate transfer body unit 80 is guided at the time of attaching the intermediate transfer body unit 80 to the image forming apparatus body 1 and at the time of detaching the intermediate transfer body 80 unit from the image forming apparatus body 1, that is, the first portion 87*a* is directed in the substantially horizontal direction or alternatively in the direction in which the left side end portion is inclined being a little raised with respect to the horizontal direction; and a second portion 87*b* directed in a direction in which the belt-shaped intermediate transfer body 20 of the intermediate transfer body unit 80 is guided to an acting position of the image forming apparatus body 1, that is, the second portion 87*b* is directed in the direction in which the right side end portion is inclined being a little raised with respect to the horizontal direction, wherein the first portion 87*a* and the second portion 87*b* are connected to each other through a bent portion 87*c*. In this connection, of course, the first portion 87*a* and the second portion 87*b* may be connected to each other through a smoothly curved portion.

On the other hand, the guide pins 85, 86 for guiding the intermediate transfer body unit 80 are attached onto the side faces on the front side and the rear side of the intermediate transfer body unit 80. These guide pins 85, 86 are respectively arranged at a position close to the end portion on the drive roller side of the intermediate transfer body unit 80 and at an intermediate position distant from the end portion on the drive roller 80 side by a predetermined distance in such a manner that the guide pins 85, 86 are respectively protruded outside. The positioning pins 88 for positioning the intermediate transfer body unit 80 are provided at positions close to the backup roller 23 on the sides of the front side and the rear side of the intermediate transfer body unit 80.

As shown in FIGS. 1 and 9, when the above intermediate transfer body unit 80 is attached to the digital color multi function machine body 1, under the condition that the side cover 90, which is provided on the side of the digital color multi function machine body 1, is opened, two guide pins 85, 86 of the intermediate transfer unit are engaged with the guide grooves 87 of the guide rail members 83, 84 of the digital multi function machine body 1. After that, as shown in FIG. 9, when the intermediate transfer body unit 80 is pushed into the digital color multi function machine body 1, two guide pins 85, 86 of the intermediate transfer body unit 80 are guided in the substantial horizontal direction along the first portions 87*a* of the guide grooves 87 of the guide rail members 83, 84 as shown in FIG. 8. In this connection, in the guide groove 87 of the above guide rail members 83, 84 at the end portion on the entry side of the guide groove 87, the protrusion 87*d*, which is formed into a crest-shape, is formed. This protrusion 87*d* prevents the guide pin 85, 86 of the intermediate transfer unit 80 from mistakenly coming out from the guide groove 87 of the guide rail members 83, 84.

Further, when the intermediate transfer body unit 80 is deeply pushed into the digital color multi function machine body 1 as shown in FIG. 8, two guide pins 85, 86 of the intermediate transfer body unit 80 are moved from the first portions 87*a* of the guide grooves 87 of the guide groove members 83, 84 to the second portions 87*b*. Then, since the second portions 87*b* of the guide grooves 87 of the guide rail members 83, 84 are inclined with respect to the first portions 87*a* and further the end portions on the right side are inclined being raised by a predetermined height with respect to the horizontal direction which is a direction in which the intermediate transfer belt 20 of the intermediate transfer body unit 80 is guided to an acting position of the apparatus body 1, the intermediate transfer body unit 80 is guided being inclined along the second portions 87*b* of the guide grooves 87 of the guide rail members 83, 84. Therefore, the intermediate transfer belt 20 of the intermediate transfer body unit 80 is guided to the acting position of the apparatus body 1.

In a state in which the intermediate transfer body unit 80 is guided along the second portions 87*b* of the guide grooves 87 of the guide rail members 83, 84, most of the intermediate transfer body unit 80 has already been inserted into the apparatus body 1. Accordingly, there is no possibility that the intermediate transfer body unit 80, which is protruded outside the apparatus body 1, interferes with other members such as a cover 90.

When attaching of the intermediate transfer body unit 80 to the digital color multi function machine body 1 has been completed, the guide pin 85 of the intermediate transfer body unit 80 is engaged with an end portion of the guide groove 87 of the guide rail members 83, 84 and the positioning pin 88 of the intermediate transfer body unit 80 is engaged with the positioning groove 91 of the guide rail members 83, 84. Therefore, the intermediate transfer body unit 80 is positioned at a predetermined position in the digital color compound body 1. When the fastening member 92 of the intermediate transfer body unit 80 is fastened to the digital color compound body 1 as shown in FIG. 7, the attaching work of the intermediate transfer body unit 80 is completed.

In this connection, when the intermediate transfer body unit 80 is detached, the order of the above attaching work is reversed.

In this embodiment, as shown in FIG. 7, the intermediate transfer body unit 80 includes a plurality of electricity power supplies 93Y, 93M, 93C, 93K which are arranged substantially in parallel with the attaching direction of attaching and detaching the intermediate transfer body unit 80 to the digital color compound body 1 and also in parallel with the direction of the intermediate transfer belt 20. The plurality of electricity power supplies 93Y, 93M, 93C, 93K feed electricity from the multi function machine body 1 side to the primary transfer rollers 21Y, 21M, 21C, 21K provided in the intermediate transfer body unit.

When the intermediate transfer body unit 80 is attached to the digital color compound body 1, the intermediate transfer body unit 80 concerned is guided along the second portion 87*b* of the guide groove 87 of the guide rail members 83, 84 and moved from downward to upward and attached at a predetermined position of the multi function machine body 1. Therefore, the plurality of electricity power supplies 93Y, 93M, 93C, 93K of the intermediate transfer body unit 80 are provided in such a manner that an electrode is exposed onto the upper end face of each electricity power supply. The electricity power supplies 94Y, 94M, 94C, 94K, which are provided on the digital color compound body 1 side corresponding to the plurality of electricity power supplies of the intermediate transfer body unit, are provided under the condition that each electrode is exposed on the lower end face of the electricity power supply. Electrodes of the plurality of electricity power supplies 93Y, 93M, 93C, 93K of the above intermediate transfer body unit 80 are formed into a spring-shape. Therefore, the plurality of electricity power supplies 93Y, 93M, 93C, 93K can be positively contacted with the electricity power supplies 94Y, 94M, 94C, 94K provided on the digital color multi function machine body 1 side so as to feed electricity.

As shown in FIG. 2, in the above digital color multi function machine, the conveyance passages 47, 51 for conveying sheets of paper for transfer are arranged on the left side of the multi function machine body 1. Accordingly, there is a possibility that sheets of paper are jammed in the conveyance passages 47, 51 for conveying sheets of paper for transfer. Therefore, as shown in FIG. 9, this digital color multi function machine is provided with, on the left side thereof, a side cover 90, which can be freely opened and closed with respect to the multi function machine body 1 having a hand feeding tray and both face unit, for exposing the conveyance passages 47, 51 to convey sheets of paper for transfer.

As described above, this side cover 90 is opened and closed when the intermediate transfer body unit 80 is attached to and detached from the apparatus body. When the intermediate transfer body unit 80 is attached to and detached from the apparatus body, this side cover 90 is greatly opened so that any problems can not be caused in the attaching and detaching operation of the intermediate transfer body unit 80. On the other hand, in the case where sheets of paper are removed at the time of trouble in which sheets of paper are jammed, it is unnecessary to greatly open the side cover 90 as compared with the case in which the intermediate transfer body unit 80 is attached to and detached from the apparatus body.

Therefore, an opening angle of the side cover 90 with respect to the digital color multi function machine body 1 can be set at least two stages. One stage is a user's operating position at which sheets of paper are removed by the user at the time of the occurrence of jam. The other stage is a maintenance position at which the intermediate transfer body unit 80 is attached to and detached from the apparatus body and the opening angle at this stage is larger than that of the stage of the user's operating position. As shown in FIGS. 10A, 10B, 11A and 11B, the opening angle of this side cover 90 can be set at least two stages when the engaging position 95*a* on the multi function machine body 1 side of the strap 95 for holding the side cover 90 is changed between the upper user's operating position 95*a*' and the lower maintenance position 95*a*". In this connection, it is usual that the opening and closing angle of the above side cover 90 is set at the user's operating position at which sheets of paper are removed at the time of the occurrence of jam. The engaging position of the strap is changed by a service engineer because the attaching and detaching work of the intermediate transfer body unit 80 is supposed to be done by the service engineer.

In this embodiment, the cleaning device 63 for cleaning a surface of the intermediate transfer belt 20 of the intermediate transfer body unit 80 must be accurately positioned with respect to the surface of the intermediate transfer belt 20. Therefore, as shown in FIG. 7, the cleaning device 63 concerned can be attached to and detached from the multi function machine body 1 only when the intermediate transfer body unit 80 is attached to the multi function machine body 1. The intermediate transfer body unit 80 can be removed from the multi function machine body 1 only when the cleaning device 63 is detached from the multi function machine body 1.

In the digital color multi function machine of this embodiment composed as described above, while the apparatus is being downsized, the maintenance and operation property of the intermediate transfer belt unit can be improved and the rigidity of the apparatus body frame can be ensured as follows.

Figure 12:
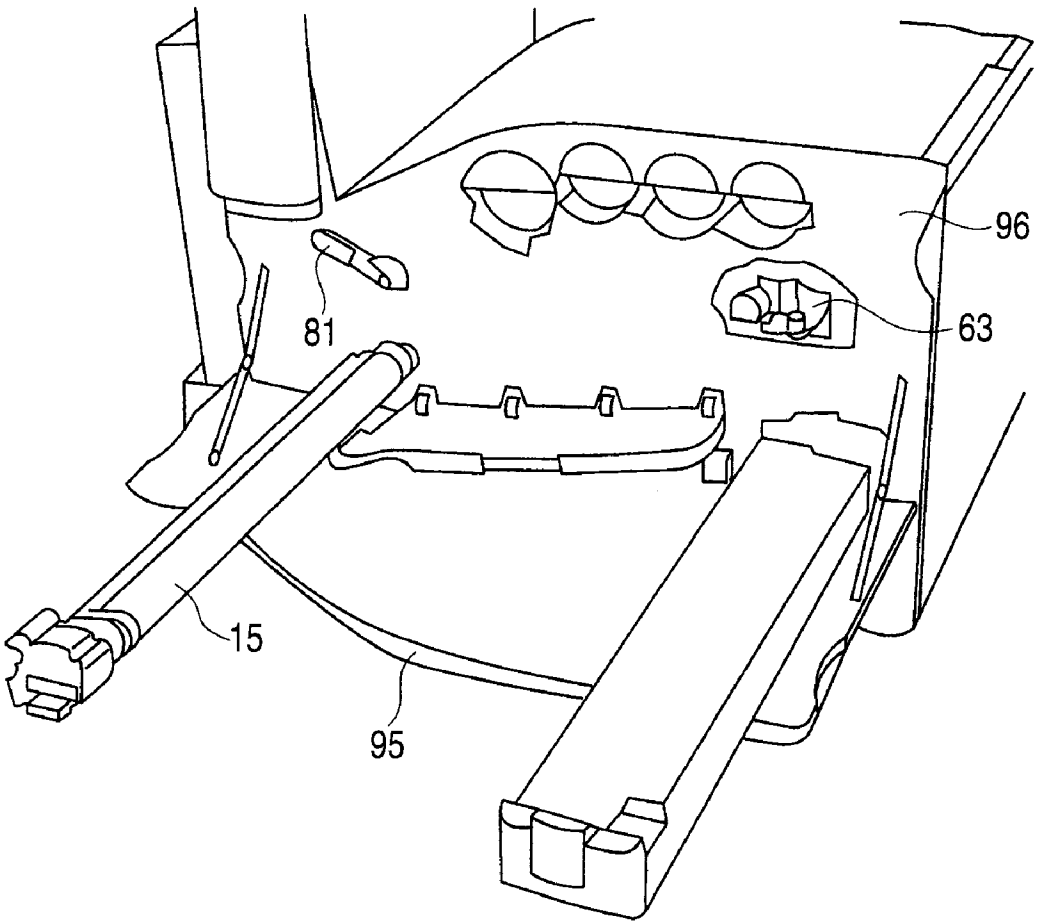
FIG. 12 is a perspective view showing a tandem type full color multi function machine that is an image forming apparatus of Embodiment 1 of the present invention.
Figure 13B:
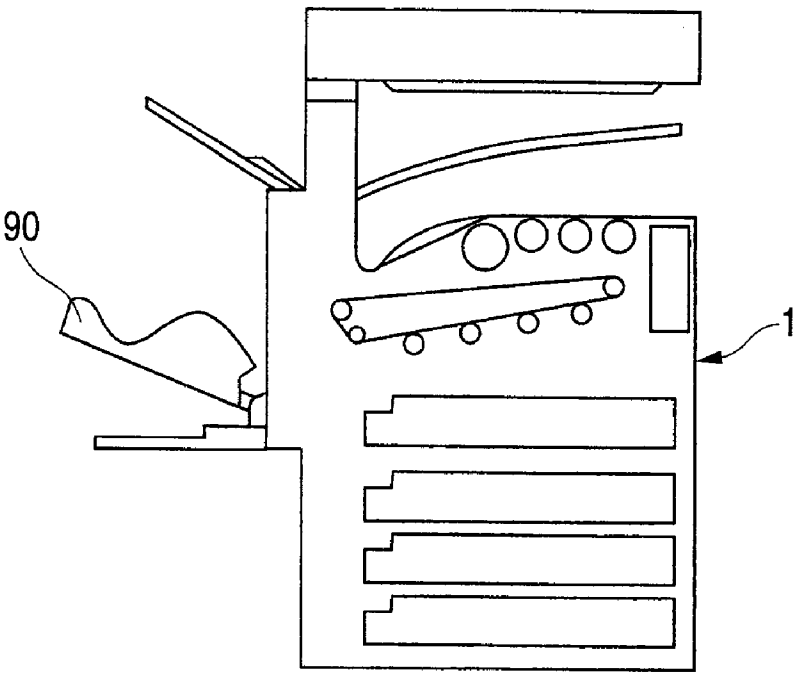
FIGS. 13A and 13B are arrangement views showing attaching and detaching operation of an intermediate transfer body unit.
Figure 13A:
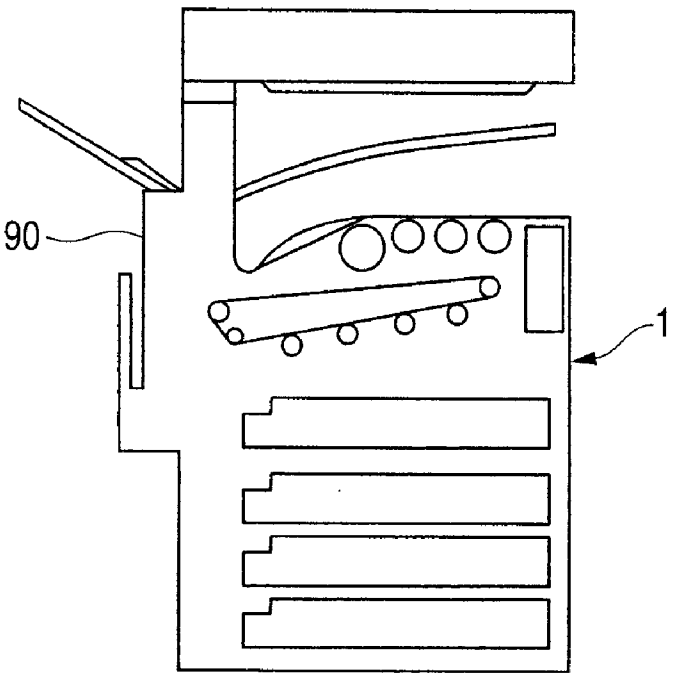
Figure 14B:
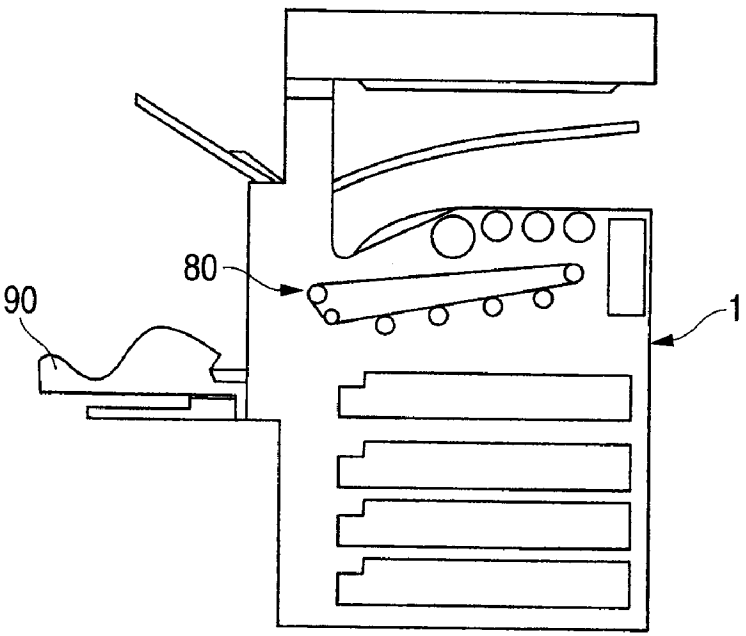
FIGS. 14A and 14B are arrangement views showing attaching and detaching operation of an intermediate transfer body unit.
Figure 14A:
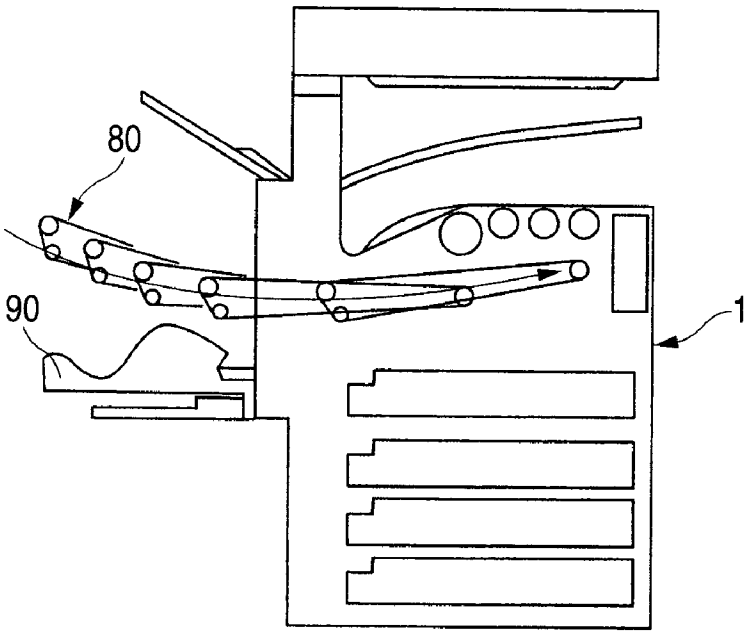

As shown in FIG. 9, in the digital color multi function machine of the present embodiment, when the intermediate transfer belt unit 80 is replaced or the maintenance and inspection work is executed, the front cover 95 provided on the front face of the digital color multi function machine 1 is opened. In the above digital color multi function machine, as shown in FIG. 9, after the cleaning device 63 of the intermediate transfer belt 20 has been drawn out to the operator's side, it is taken out from the multi function machine body 1. In the above digital color multi function machine, as shown in FIGS. 6 and 12, when the retracting handle 81 of the intermediate transfer belt unit 80 is operated being rotated, the intermediate transfer belt 20 is separated from the photoreceptor drums 15 of the image forming units 13Y, 13M, 13C, 13K.

Figure 11A:
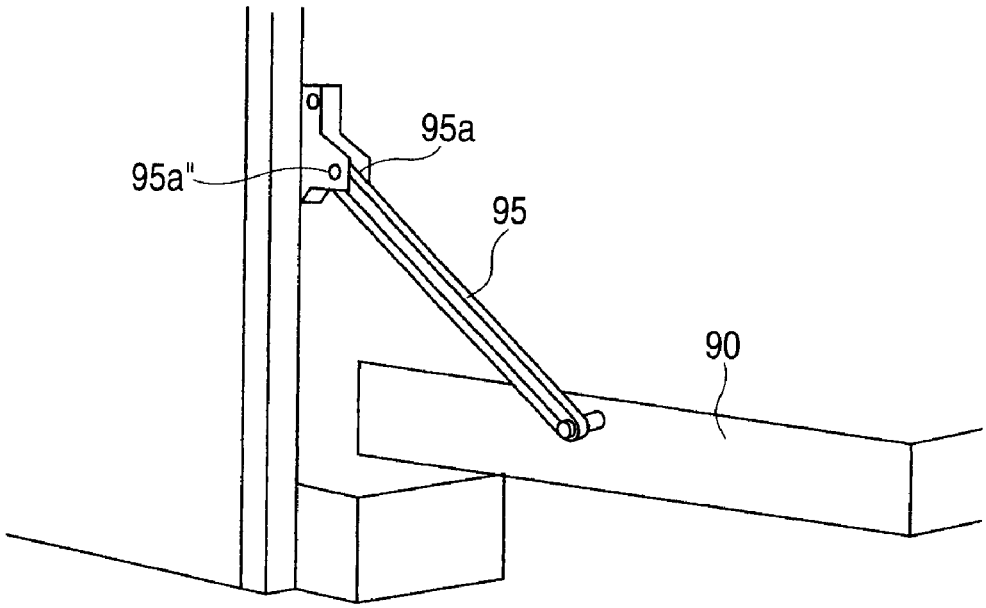
FIGS. 11A and 11B are arrangement views showing an opening and closing state of a side cover.
Figure 11B:
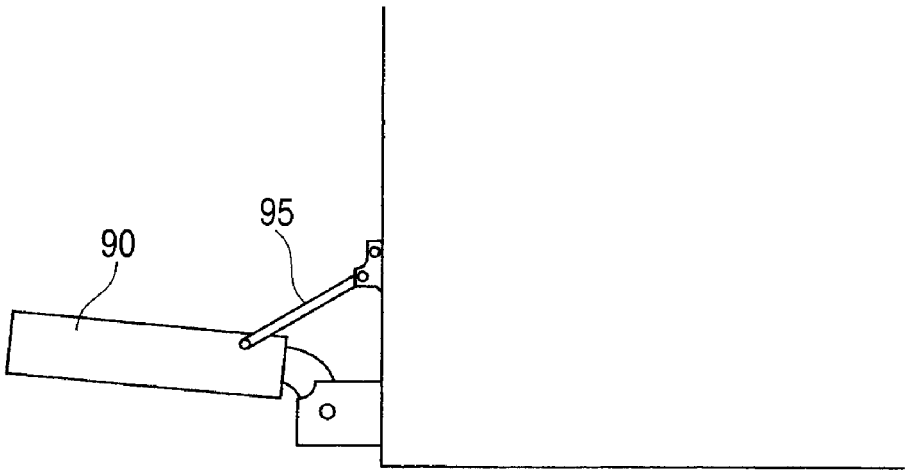

As shown in FIG. 9, in the above digital color multi function machine, the side cover 90 provided on the side of the digital color multi function machine body 1 is opened. As shown in FIGS. 11A and 11B, at the same time, an engaging position on the multi function machine body 1 side of the strap 95 for holding the side cover 90 is changed to the lower maintenance position, so that an opening angle of the side cover 90 can be increased.

Further in the above digital color multi function machine, as shown in FIG. 7, the fastening member 92 of the intermediate transfer body unit 80 is detached from the digital color multi function machine body 1. While an operator is holding the intermediate transfer body unit 80 with the hand, the intermediate transfer body unit 80 is gradually drawn out onto the side of the multi function machine body 1. At this time, as shown in FIG. 8, the intermediate transfer body unit 80 is moved from the inclination angle, which is formed along the second portion 87*b* of the guide groove 87 of the guide rail members 83, 84, to the inclination angle, which is formed along the first portion 87*a*. Therefore, an end portion on the left side of the intermediate transfer body unit 80 is gradually inclined upward.

Therefore, as shown in FIGS. 13A, 13B, 14A and 14B, the above intermediate transfer body unit 80 can be drawn out onto the side of the multi function machine body 1 and easily detached from the digital color multi function machine body 1 without making interference with the side cover 90 of the digital color multi function machine.

The above intermediate transfer body unit 80 is drawn out onto the side of the digital color multi function machine body 1. Therefore, unlike the case in which the intermediate transfer body unit 80 is drawn out onto the front side of the digital color multi function machine body 1, it is unnecessary to provide a large opening portion on the front face of the multi function machine body 1. Therefore, the rigidity of the multi function machine body 1 is not deteriorated. As a result, it is unnecessary to excessively increase the rigidity of the multi function machine body 1. Accordingly, the digital color multi function machine body 1 can be downsized.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a plurality of image forming units that form toner images having colors being different from each other;

a belt-shaped intermediate transfer body that is arranged on an upper side of the plurality of image forming units in a state that the belt-shaped intermediate transfer body is inclined with respect to a horizontal direction, the toner images formed by the plurality of image forming units being transferred onto the belt-shaped intermediate transfer body;

an intermediate transfer body unit that holds the belt-shaped intermediate transfer body to be freely attached to and detached from an apparatus body; and a guide rail member that guides the intermediate transfer body unit to be freely attached to and detached from a lateral side of the apparatus body, and that is set so that a direction, in which the intermediate transfer body unit is guided, is changed in the middle of the guiding, wherein, the belt-shaped intermediate transfer body that is arranged in a state that the belt-shaped intermediate transfer body is inclined with respect to the horizontal direction so that a downstream side portion of the belt-shaped intermediate transfer body in an attaching direction is raised, the guide rail member comprises:

a first portion that is arranged in a substantially horizontal direction, or arranged in an inclined direction in which an upstream side portion of the belt-shaped intermediate transfer body in the attaching direction is raised with respect to the horizontal direction;

a second portion that is located on a downstream side of the attaching direction of the belt-shaped intermediate transfer body with respect to the first portion, and is inclined so that the downstream side portion of the belt-shaped intermediate transfer body in the attaching direction is raised with respect to the horizontal direction.

2. The image forming apparatus as claimed in claim 1, wherein the guide rail member extends from a front side to a rear side of the apparatus body.

3. The image forming apparatus as claimed in claim 1, wherein the first portion and the second portion of the guide rail member are connected to each other through a bent portion or a curved portion.

4. The image forming apparatus as claimed in claim 1, wherein the intermediate transfer body unit comprises:

a plurality of power supplies that are arranged substantially in parallel with a direction in which the intermediate transfer body unit is attached to and detached from the apparatus body, and arranged in parallel with an edge of the belt-shaped intermediate transfer body.

5. The image forming apparatus as claimed in claim 1, wherein the intermediate transfer body unit comprises:

a stopper mechanism that is freely attached to and detached from the apparatus body only in a case where the belt-shaped intermediate transfer body is separate from the plurality of image forming units.

6. The image forming apparatus as claimed in claim 1, further comprising:

a side cover that is provided on one side of the apparatus body, and is freely opened and closed so as to attach the intermediate transfer body unit to the apparatus body and detach the intermediate transfer body unit from the apparatus body, wherein the side cover has an opening angle that is set at least two stages including:

a user operation position at which a jammed sheet of paper is removed; and a maintenance position at which the opening angle is further increased as compared with the opening angle at the user operation position so that the intermediate transfer body unit is attached to and detached from the apparatus body.

7. The image forming apparatus as claimed in claim 1, further comprising:

a cleaning device that cleans a surface of the belt-shaped intermediate transfer body, and that is freely inserted into and drawn out from the front side of the apparatus body, wherein the cleaning device is freely inserted into and drawn out from the intermediate transfer body unit attached to the apparatus body.

8. The image forming apparatus as claimed in claim 1, wherein:

the belt-shaped intermediate transfer body comprises:

a first guide pin and a second guide pin that are supported by the guide rail member to guide the belt-shaped intermediate transfer body, in a state where the first guide pin and the second guide pin are supported by the first portion, the belt-shaped intermediate transfer body is arranged in a substantially horizontal state, or arranged in a state that the upstream side portion of the belt-shaped intermediate transfer body in the attaching direction is raised with respect to the horizontal direction, in a state where the first guide pin and the second guide pin are supported by the second portion, the belt-shaped intermediate transfer body is arranged in a state that the downstream side portion of the belt-shaped intermediate transfer body in the attaching direction is raised with respect to the horizontal direction, and an inclination angle of the belt-shaped intermediate transfer body varies at stages which has a stage where the first guide and the second guide pin are supported by the first portion, a stage where the first guide pin is supported by the first portion and the second guide pin is supported by the second portion, and a stage where the first guide pin and the second guide pin are supported by the second portion, in that order.

* * * * *